US006796151B1

(12) United States Patent
Eggers et al.

(10) Patent No.: US 6,796,151 B1
(45) Date of Patent: Sep. 28, 2004

(54) METHOD OF DYEING A TEXTILE SUBSTRATE IN AT LEAST ONE SUPERCRITICAL FLUID AND A DYEING DEVICE

(75) Inventors: Rudolf Eggers, Buxtehude (DE); Kurt Truckenmuller, Heilbronn (DE)

(73) Assignee: Amann & Soehne GmbH & Co., Boenningheim (DE)

( * ) Notice: Subject to any disclaimer, the term of this patent is extended or adjusted under 35 U.S.C. 154(b) by 259 days.

(21) Appl. No.: 09/599,664

(22) Filed: Jun. 22, 2000

(30) Foreign Application Priority Data

Jun. 22, 1999 (DE) ..... 199 28 405

(51) Int. Cl.[7] ..... D06B 23/00
(52) U.S. Cl. ..... 68/207
(58) Field of Search ..... 68/184, 189, 207

(56) References Cited

U.S. PATENT DOCUMENTS 3,165,910 A * 1/1965 Thies ..... 68/189 X 5,953,780 A * 9/1999 Schollmeyer et al. ..... 68/189 X

* cited by examiner

*Primary Examiner*—Philip R. Coe
(74) *Attorney, Agent, or Firm*—Greenberg Traurig, LLP

(57) ABSTRACT

A method and a device for dyeing a textile substrate in at least one supercritical fluid, are described, whereby the textile substrate is arranged in an autoclave, where at least one supercritical fluid loaded with a dyestuff flows over and/or through the textile substrate, and the at least one powdered dyestuff is brought in contact with the supercritical fluid, forming a stable solution and/or dispersion of the dyestuff in the supercritical fluid. The quantity of dyestuff required for dyeing is divided into a plurality of dyestuff partial quantities, and each partial quantity of dyestuff is separately brought in contact with the supercritical fluid until this partial quantity of dyestuff is dissolved or dispersed. Hereafter the next partial quantity of dyestuff is introduced into the supercritical fluid, and this process is repeated several times until the total quantity of dyestuff has been introduced into the supercritical fluid.

10 Claims, 2 Drawing Sheets

Figure 1:
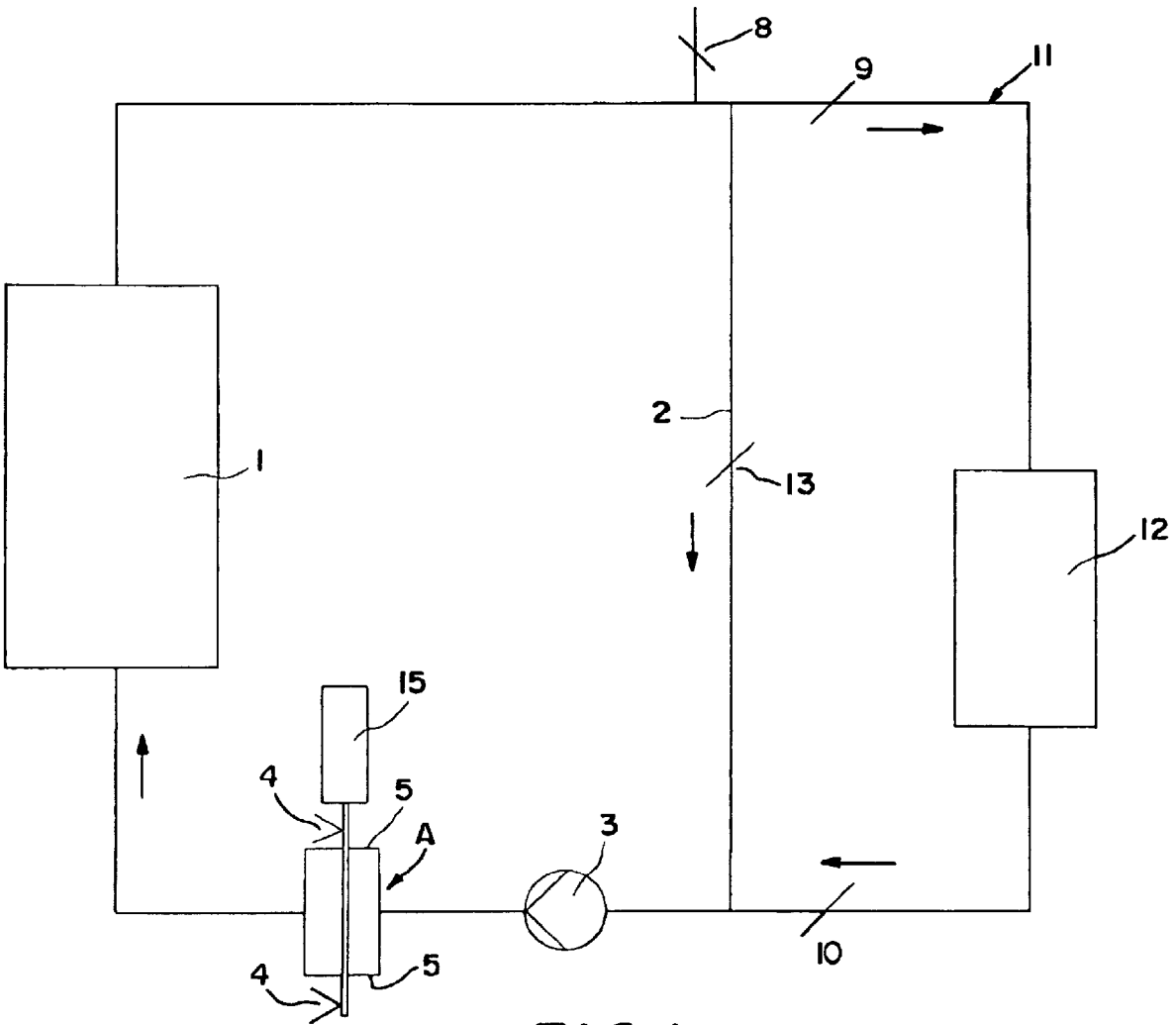

METHOD OF DYEING A TEXTILE SUBSTRATE IN AT LEAST ONE SUPERCRITICAL FLUID AND A DYEING DEVICE

The present invention concerns a method of dyeing a textile substrate in at least one supercritical fluid, preferably for dyeing bobbins of yarn in supercritical carbon dioxide and a dyeing device for carrying out the method.

For several years, a method of dyeing textile substrates in supercritical fluids has been propagated, whereby the principles of dyeing in a supercritical fluid being described in German Patent Application No. 39 06 724 A.

German Patent Application No. 196 31 604 A describes a proposal for introducing the dyestuff required for dyeing into supercritical fluids, where the introduction of the dyestuff to be dissolved or dispersed in the respective supercritical fluid is accomplished by having the supercritical fluid loaded with the dyestuff flow through a special dye bath container filled with the total amount of the dyestuff and arranged in a bypass.

In general, the method of introducing the dyestuff into the supercritical fluid as described in German Patent Application No. 196 31 604 A functions satisfactorily. With certain dyestuffs, however, which have a tendency to sinter, for example, because of their low melting point when large quantities of dyestuff are placed in the dye batch vessel, the known method causes an additional expense in that inert particles must be added to the bulk dyestuff for this purpose or special dyestuff granules must be used.

The object of the present invention is to provide a method of the type described here and a suitable device which will permit rapid and especially simple introduction of the respective dyestuff into the supercritical fluid even when working with dyestuffs that tend to cake or sinter.

This object is achieved according to this invention by a method and by a device having the characterizing features set forth hereinbelow.

The method according to this invention for dyeing a textile substrate in at least one supercritical fluid, preferably for dyeing bobbins of yarn in supercritical carbon dioxide, like the known methods provides for the respective textile substrate to be arranged in an autoclave, where at least one supercritical fluid containing a dyestuff flows over (perfuse) and/or flows through (superfuses) it. First, the minimum of one solid, preferably powdered dyestuff is brought in contact with the supercritical fluid, forming a stable solution and/or dispersion of the dyestuff in the supercritical fluid. In deviation from the state of the art described above, however, the quantity of dyestuff required for dyeing is divided in the method according to this invention into a plurality of dyestuff partial quantities, and each partial quantity of dyestuff by itself remains in contact with the supercritical fluid until this partial quantity of dyestuff is dissolved or dispersed. As soon as this is the case, the next partial quantity of dyestuff is introduced into the supercritical fluid in the method according to this invention, with the procedure described above being repeated as often as necessary until the required total dyestuff quantity calculated in advance has been dissolved or dispersed in the supercritical fluid so that this dissolved or finely dispersed dyestuff can be absorbed by the respective textile material to be dyed.

Although at first glance, the method according to this invention may appear to be more complicated than that according to the state of the art, because with the method according to this invention the quantity of dyestuff to be dissolved or dispersed is first divided into a plurality of dyestuff partial quantities and then introduced separately and in succession into the supercritical fluid, it has surprisingly been found that the method according to this invention does not require any more time in comparison with the dyeing methods practiced in the past, especially with critical dyestuffs which have a tendency to agglomerate or to sinter. This is attributed to the fact that with the method according to this invention, a relatively large amount of supercritical fluid is available for relatively small partial quantities of dyestuff, so that the dissolving or dispersing of the dyestuff in the supercritical fluid are accelerated accordingly without resulting in any agglomeration or sintering of the respective partial quantity of dyestuff. Therefore, the method according to this invention also makes it possible to omit the addition of inert particles or preparing a certain size of dyestuff granules, as is the case with critical dyestuffs with the known method.

In addition, it has also proven to be an advantage of the method according to this invention that the composition of the partial quantity of dyestuff can be varied according to how the dyeing turns out, i.e., the shade and/or depth of color, so that by using the method according to this invention, nuancing of the dyeing is possible at any time, which is also impossible with the state of the art. Due to the fact that the partial quantity of dyestuff is introduced into the main stream of the supercritical fluid which is pumped in circulation with the method according to this invention, the dissolving or dispersing process of the partial quantity of dyestuff introduced in the respective case is greatly accelerated, which is not the case with the state of the art in particular when the dye batch vessel (color/trough) is arranged in a bypass to the main stream. Also, the partial quantity of dyestuff used in the method according to this invention does not cause any mentionable back pressure in comparison with the total quantity of dyestuff traditionally used, so that with the method according to this invention, the flow through this partial quantity of dyestuff can be much better, which in turn causes a great acceleration of the dissolving or dispersing behavior of the respective dyestuff used in the supercritical fluid.

By way of clarification, it should be pointed out that the term dyestuff used in the present patent application includes both an individual dyestuff as well as a dyestuff mixture consisting of two to twelve dyestuffs in particular. In addition, the term supercritical fluid includes in particular the fluids described in German Patent Application No. 39 06 724 A, but supercritical carbon dioxide is preferred in the method according to this invention. The method according to this invention preferably also includes such a method where bobbins of yarn, in particular bobbins of sewing yarn, are dyed with disperse dyes in supercritical carbon dioxide, and the disperse dyes used for this purpose include in particular conventional commercial disperse dyes such as those widely available commercially and used for aqueous dyeing of bobbins of polyester yarn. The yarn material preferably used in the method according to this invention includes or consists in particular of polyester, with polyethylene terephthalate (PET) yarn materials preferably also falling under this heading in addition to modified types of polyester.

A first embodiment of the process according to this invention provides for the quantity of dyestuff required for dyeing to be divided into 5 to 200, in particular 20 to 90 partial quantities of dyestuff, where it has surprisingly been found that such a division over the aforementioned partial quantities of dyestuff with a plurality of dyestuffs and dyestuff mixtures and over a broad range of shades and depths of color leads to excellent results, in particular so far as the required total quantity of dyestuff is dissolved or dispersed in the supercritical fluid within an extremely short period of time without occuring agglomerations or fused dyestuffs, resulting in especially even dyeings and good colorfastness.

In particular when each partial quantity of dyestuff is introduced into the stream of supercritical fluid in the method according to this invention in such a way that the total supercritical fluid circulated per unit of time is brought in contact with the partial quantity of dyestuff at least once, such a variant of the process has the effect that the total quantity of dyestuff is dissolved especially rapidly, and a supercritical dye bath which always has the same concentration of dissolved or dispersed dyestuff is used for dyeing the textile substrate, so that such a supercritical dye bath always contains a maximum of dissolved or dispersed dyestuff accordingly.

It is especially advantageous from the standpoint of reproducibility of the dyeing and the rate of dissolving or dispersing of the dyestuff within the supercritical fluid if the partial quantities of dyestuff are brought in contact with the supercritical fluid immediately downstream from the circulation pump for the supercritical fluid. Thus, downstream from the circulation pump and upstream from the autoclave, the partial quantities of dyestuff are fed into the supercritical fluid, whereby this feed preferably being introduced in this case into the main flow line.

With regard to the temperature and pressure conditions under which the plurality of partial quantities of dyestuff are introduced into the supercritical fluid in the method according to this invention, it should be pointed out that it has proven especially suitable if the plurality of dyestuff partial quantities are introduced into the supercritical fluid under the temperature and pressure conditions selected for the respective dyeing. Due to such an embodiment of the method according to this invention, the reproducibility of each dyeing is further optimized with regard to the resulting color outcome (shade and depth of color) and the fastness of the dyeing produced, so that with faulty dyeings or deviant dyeings are ruled out such a procedure.

The present invention also concerns a device for introducing a dyestuff into a supercritical fluid used for dyeing a textile substrate.

The device according to this invention with which it is possible to introduce a dyestuff in partial quantities into a supercritical fluid used for dyeing a textile substrate is provided with an autoclave which has a fluid circulation system, whereby the dye bath circulation system includes a circulation pump. The device according to this invention has a dyestuff feed mechanism which can move between a first position, where at least one dyestuff uptake section of the dyestuff feed mechanism is freely accessible, and a second position, where at least one dyestuff uptake section is in contact with the supercritical fluid, and vice versa. In other words, the dyestuff feed mechanism provided on the device according to this invention ensures that the corresponding partial quantity of dyestuff is fed into the supercritical fluid without having to change the temperature and/or pressure of the supercritical fluid; this is accomplished through a movement of the dyestuff feed mechanism out of a first position, where the at least one dyestuff uptake section is freely accessible and can be loaded with the partial quantity of dyestuff, into the second position, where the dyestuff uptake section loaded with said partial quantity of dyestuff is brought in contact with the supercritical fluid.

The device according to this invention has a number of advantages. It should be pointed out first that with the help of the device according to this invention, dyestuff can be introduced into the system at any time and in any desired quantity without requiring changes in the temperature and/or pressure of the supercritical fluid. In addition, the device according to this invention allows the metered addition of dyestuff as described above without increasing the volume of the system, which is not possible in the state of the art when a corresponding dye batch vessel is arranged in a bypass. There is necessarily an increase in volume with the known system when the supercritical fluid is diverted through the bypass and through the dye batch vessel, which in turn results in an unwanted change in temperature and/or pressure conditions in the system, unless a corresponding supercritical fluid is arranged in the bypass and in the dye batch vessel in advance, with its temperature and pressure corresponding to the temperature and pressure in the main circulation system, which is complicated accordingly and can be achieved only with an increased control expense. Thus, the device according to this invention permits rapid metered addition of the dyestuff in an especially simple manner without resulting in the corresponding fluctuations in pressure and/or temperature of the supercritical fluid, so that the device according to this invention also contributes significantly to the reproducibility of dyeings. Furthermore, another advantage is that the device according to this invention permits a simple and individual adjustment of the quantity of dyestuff used in each case, so that, depending on the outcome of a dye batch, a dyeing operation can be terminated or additional dyestuff can be added subsequently or other dyestuffs added to influence the nuance of the dyeing achieved so far without this necessitating blocking a dye batch vessel and the respective bypass lines, venting the lines and applying pressure again, as is always the case in the state of the art. Therefore, the device according to this invention contributes significantly toward shortening the total dyeing times, improving the reproducibility of the dyeing and preventing defective dye batches, where the use of the device according to this invention also influences to a significant extent the profitability of the dyeing process.

In a first embodiment of the device according to this invention, the dyestuff feed mechanism is designed as a rod that is displaceable across the direction of flow of the supercritical fluid, where the rod has at least one dyestuff uptake section designed as a ring-shaped groove and/or as a through-hole. Such a rod-shape dyestuff feed mechanism permits metered addition of the partial quantity of dyestuff picked up by the ring-shaped groove and/or through-hole into the supercritical fluid; this requires only that by an axial displacement of the rod, the latter is moved out of the first position in which the respective partial quantity of dyestuff is arranged in the groove and/or through-hole and into the second position, where the partial quantity of dyestuff is dissolved or dispersed out of the groove and/or through-hole by the supercritical fluid flowing across it in this second position. Such a rod-shaped dyestuff feed mechanism then preferably has two grooves and/or two through-holes arranged with an axial distance between them, with the axial spacing of these two grooves and/or two through-holes being selected so that one groove and/or two through-hole is freely accessible from the outside and thus can be loaded with the partial quantity of dyestuff (first position), while the other groove and/or two through-hole in each case is positioned in the supercritical fluid at this time (second position). Details regarding this preferred embodiment are explained in greater detail below with regard to the concrete examples.

In a further refinement of the embodiment of the device according to this invention described above, it has a housing, preferably a cylindrical housing, where the cylindrical housing is provided with a connecting area to supply the supercritical fluid and with a discharge area for discharging the supercritical fluid loaded with dyestuff. The rod-shaped dye feed mechanism described above is provided inside this housing and is preferably designed as an axially displaceable rod, with grooves and/or through-holes arranged in the rod, which preferably moves across the direction of flow of the supercritical fluid in the housing.

In another refinement of the embodiment of the device according to this invention described above, the housing preferably has opposing sealed closures, where the opposing sealed closures have in particular bearing and seal elements for fluid-tight axially displaceable bearing of the dyestuff feed mechanisms designed as rods.

To ensure that with the device according to this invention, the partial quantity of dyestuff introduced through the dyestuff feed mechanism is dissolved or at least finely dispersed, the at least of one through-hold is provided with removable sieve plates at the head and/or at the base. This prevents coarsely dispersed dyestuff particles from being flooded out of the through-hole by means of the supercritical fluid and then being deposited on the textile substrate to be dyed in an unwanted manner, causing corresponding defects there. As an alternative or in addition, a corresponding sieve plate may be arranged with the discharge area to discharge the supercritical fluid loaded with dyestuff such that the fluid loaded with dyestuff must flow through this sieve plate before leaving the housing, so that in this way, coarsely dispersed dyestuff particles are also prevented in the dyestuff-loaded supercritical fluid.

In particular with the embodiments described previously, the sieve plate is designed as a sintered metal plate whose pores have a pore size equal to or less than 30 $\mu$m, preferably equal to or less than 15 $\mu$m, so that this sieve plate effectively prevents the generating of coarsely dispersed dyestuff particles in the supercritical fluid.

With a differently designed embodiment of the device according to this invention, the dyestuff feed mechanism is designed as a rotating disk, where this disk has at least one dyestuff uptake section on its outer edge, preferably at least two dyestuff uptake sections distributed uniformly over its radial extent, preferably on its outer edge. With the embodiment mentioned last, which has at least two dyestuff uptake sections, the latter are arranged in such a way that there is always at least one dyestuff uptake section in the first position and the at least one other dyestuff uptake section is in the second position, so that by rotating the disk, the at least one dye uptake section can be moved from the first position into the second position and the at least one other dye uptake section can at the same time be moved out of the second position into the first position. In the first position, the dyestuff uptake section can be loaded with the partial quantity of dyestuff to be introduced at that point, while in the second position, which is achieved by rotating the disk, the respective dyestuff uptake section is brought in contact with the supercritical fluid, so that the partial quantity of dyestuff can thus be dissolved or finely dispersed.

With this embodiment of the device according to this invention as described above, the rotating disk is preferably aligned across the main direction of flow of the supercritical fluid, thereby facilitating the dissolving or fine dispersing of the partial quantity of dyestuff accordingly.

An especially suitable variant of the embodiment of the device according to this invention described above which permits rapid metering of the dyestuff includes a disk having four to eight dyestuff uptake sections distributed uniformly over its circumference in the area of its outer edge, so that in this embodiment there are always two to four dyestuff uptake sections in the first position and also two to four dyestuff uptake sections in the second position accordingly.

It is especially suitable with the embodiment described above if the dyestuff uptake sections are designed as through-holes which extend preferably in the main direction of flow of the supercritical fluid. Thus, in the second position, the supercritical fluid can flow through these through-holes and can rapidly dissolve or finely disperse the partial quantity of dyestuff contained in it, so that the addition of dyestuff is accelerated accordingly in this embodiment of the device according to this invention.

As described previously, an advantageous refinement of the embodiment of the device according to the present invention as described above provides for the through-holes to be closable whereby a sintered metal plate at the head or at the bottom, with the pores in this metal plate having a pore size less than or equal to 30 $\mu$m, preferably less than or equal to 15 $\mu$m. This prevents coarsely dispersed particles from entering the fluid stream, where they could cause defective dyeings as mentioned above, whereby in addition to the arrangement of the sintered metal plates at the through-holes or instead of the arrangement of sintered metal plates at the through-holes, a corresponding sintered metal plate may also be provided for the discharge area for discharging the supercritical fluid loaded with dyestuff, so that the supercritical fluid loaded with dyestuff can then be discharged through this sintered metal plate and sent to the dyeing autoclave.

To simplify handling of the device according to this invention, an especially advantageous embodiment of the device according to this invention provides for the dyestuff feed mechanism to be provided with a dyestuff charging device, whereby this dyestuff charging device supplies a predetermined partial quantity of dyestuff to each dyestuff uptake section.

Advantageous refinements of the process according to this invention and the device according to the present invention are described in the sub-claims.

The device according to this invention is described in greater detail below on the basis of one embodiment in conjunction with the drawing showing in FIG. 1 a schematic flow chart of a corresponding installation for dyeing textile substrates in supercritical fluids, and FIG. 2 a schematic sectional view through an embodiment of the device according to this invention.

FIG. 1 shows a schematic dyeing installation, where this dyeing installation includes a dyeing autoclave 1 in which for example a column consisting of four cross-wound bobbins of a sewing yarn for dyeing is arranged.

The dyeing autoclave 1 is equipped with a first circulation system, where the first circulation system comprises a corresponding pipeline system 2. A circulation pump 3 is arranged inside the pipeline system 2 of the first circulation system, and in addition, a heat exchanger (not shown) and a feed system for the supercritical fluid are provided for the first circulation system. Downstream from the circulation pump 3, a device A for introducing a dyestuff in partial quantities is provided in the pipeline system 2, this device being shown in detail in FIG. 2.

In addition to the first circulation system, a second circulation system, labeled on the whole as 11, is also provided in the installation shown schematically in FIG. 1. This second circulation system 11, which can also be referred to as an adsorption cycle, has three valves 9, 10 and 13 and an autoclave 12, where the autoclave 12 is filled with a suitable sorbent, such as a silica gel of the Trysil type. This silica gel preferably has a particle size between 2 mm and 8 mm, a density of 2.200 kg/m$^3$, a bulk density of 550 kg/m$^3$, a porosity of 0.55, an internal surface area of approx. 450 m$^2$/g, a pore volume of 0.4 cm$^3$/g, an average pore diameter between 4 nm and 10 nm and a tortuosity factor of 5.0.

The installation shown here functions as follows:

First the column of the four sewing yarn cross-wound bobbins of polyethylene terephthalate, for example, is arranged inside autoclave 1. After closing autoclave 1, the corresponding pipeline system 2 of the first circulation system and the autoclave 1 itself are filled with a supercritical fluid, in particular supercritical carbon dioxide, through the feed system (not shown here) and a booster pump (not shown). Then operation of circulation pump 3 is started, which leads to the supercritical fluid flowing through the pipeline system 2 and the autoclave 1 in the direction of the arrow. At this time, valves 9 and 10 are closed and valve 13 is open.

After reaching the preselected dyeing temperature and pressure, the individual partial quantities of the dyestuff required for the dyeing operation are fed through device A, which is described below in detail in conjunction with FIG. 2.

After a preselected dyeing time has elapsed, for example, 25 to 35 minutes, valves 9 and 10 shown in FIG. 1 are opened and valve 13 is closed without any change in pressure and temperature. As a result, the flow passes through the second circulation system 11 and the autoclave 12 provided therein it in the direction of the arrow.

After a dwell time of five minutes, the pressure in the entire installation is released through the opened valve 8, so the dyed bobbins of yarn can be removed.

To prevent unwanted fluctuations in temperature and/or pressure when the first circulation system is connected to the second circulation system at the end of the actual dyeing operation, the second circulation system had previously been filled with supercritical fluid at a pressure and a temperature corresponding to the pressure and temperature of the supercritical fluid during dyeing.

Figure 2:
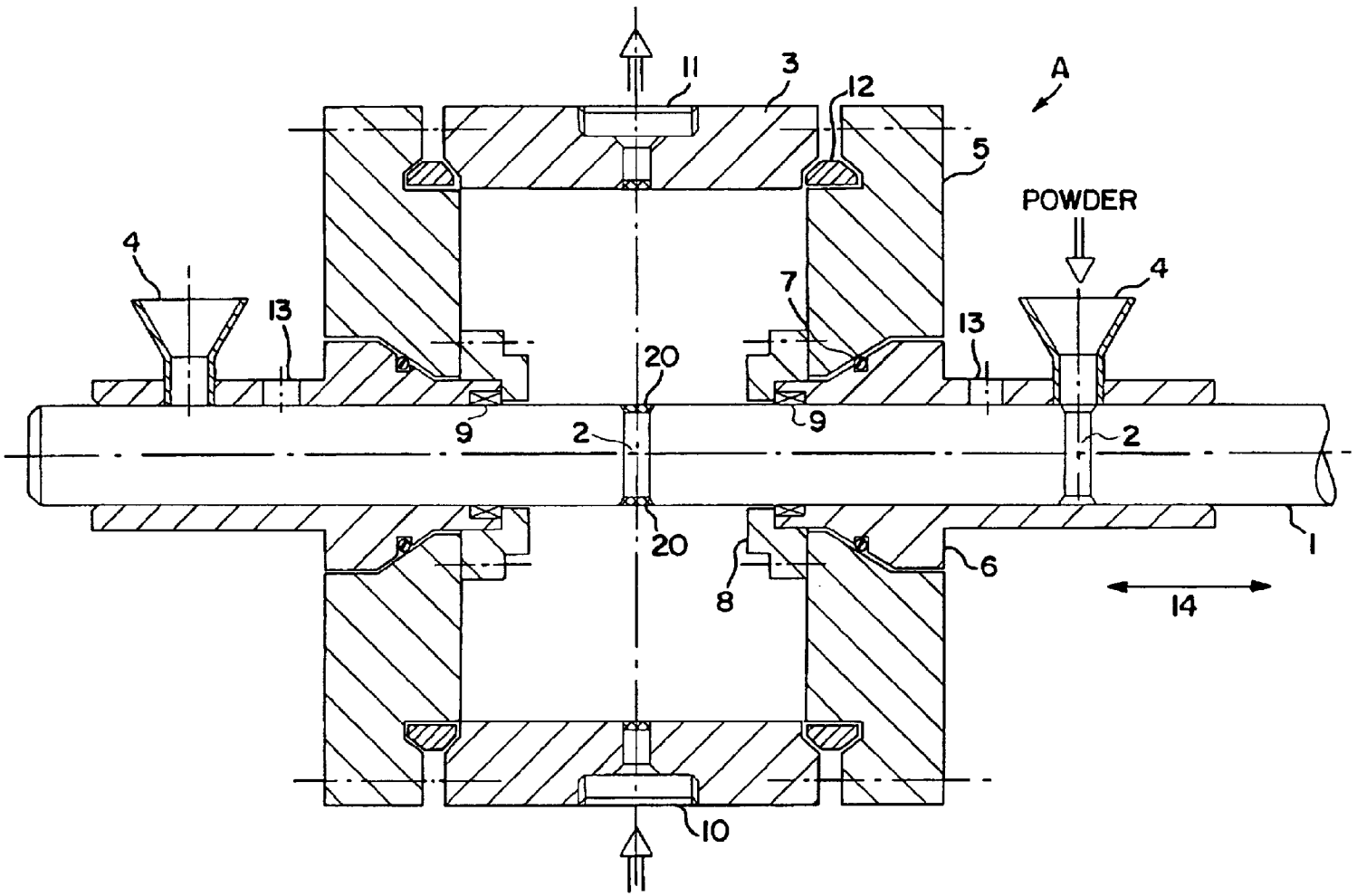

Device A shown schematically in detail in FIG. 2 for adding a dyestuff in partial quantities has a laterally displaceable dyestuff feed mechanism designed as a rod 1, where the rod 1 has two dyestuff uptake sections 2. These dyestuff uptake sections 2 are designed as through-holes, and a sintered metal plate 20 may be provided at both the head and the foot of each through-hole 2.

Rod 1 is arranged centrally inside a housing 3, whereby housing 3 has a connecting area 10 for supplying supercritical fluids and a discharge area 11 for discharging the supercritical fluid loaded with dyestuff. The direction of flow of the supercritical fluid in housing 3 is characterized by the appropriate arrows. On both sides, the housing 3 is sealed with a cover 5 designed as a sealed flanged cover, with an essentially known double conical ring 12 being provided for sealing the cover 5 with respect to the housing 3.

Each cover 5 is provided with suitable bearing and sealing elements, with these bearing and sealing elements comprising a sleeve 6 which is screwed into a flanged cover and has a circumferential seal 7 accommodated in its conical area. The internal seal with respect to the axially moving rod 1 is accomplished through a self-sealing packing secured by a sealing cover 8 or as an alternative to that, by a spring ring seal 9 such as those conventionally used in the respective field of the art.

The sleeve 6 is also provided with a pressure relief bore 13 pointing toward the atmosphere, so that after the through-hole 2 is emptied, the supercritical fluid accommodated therein can escape to the atmosphere through this pressure relief bore 13 with an axial displacement of the rod 1.

The sleeve 6 is also provided with a dyestuff charging device 4, where this dyestuff charging device 4 consists of a hopper in the embodiment illustrated here.

The device A described above in conjunction with FIG. 2 operates as described below:

The rod 1 which is laterally displaceable in direction of the arrow 14 and vice versa and has two through-holes 2 provided in it may assume a position such as that illustrated in FIG. 2. The right through-hole 2 is shown here in a first position, where the right through-hole 2 can be filled with a partial quantity of powdered dyestuff through the hopper 4, while the left through-hole 2 is in its second position where the partial quantity of dyestuff arranged in it is dissolved or finely dispersed by the supercritical fluid flowing through and past it. After the partial quantity of dyestuff in the left through-hole 2 has dissolved or dispersed, rod 1 is displaced to the left until the left through-hole 2 is flush with the hopper 4. At this time, the right through-hole 2 has arrived at a position where it is in contact with the supercritical fluid, so that the partial quantity of dyestuff arranged therein is dissolved or finely dispersed, while the left through-hole 2 is again filled with a further partial quantity of dyestuff. Through an axial displacement to the right, then both through-holes then return to a position as illustrated in FIG. 2. During the axial displacement of the rod 1, the through-holes 2 come into alignment with the corresponding pressure relief holes 13, which leads to the fact that the amount of fluid stored in the through-holes, which have been emptied of dyestuff in the meantime, can escape with no problem.

Due to repeated axial displacement of the rod 1 in the manner described above, the required quantity of dyestuff, divided into a plurality of dyestuff partial quantities, can be introduced rapidly into the main stream of the supercritical fluid within the shortest possible amount of time, with a suitable hydraulic cylinder 15 being used for the axial displacement of the rod 1, as illustrated schematically in FIG. 1.

To prevent coarsely dispersed dyestuff particles from being discharged from housing 3 with the special embodiment of device A shown in FIG. 2, appropriate sintered metal plates are provided for the connecting area 10 and the discharge area 11 as described above.

If it is desirable or necessary, baffles or fluid control elements may be provided inside the housing 3 to alter the flow of the supercritical fluid in the housing 3 accordingly, to thereby accelerate the dissolving or fine dispersing of the partial quantity of dyestuff from the through-hole.

What is claimed is:

1. A device for introducing a dyestuff in partial quantities into a supercritical fluid used for dyeing a textile substrate being arranged in an autoclave, wherein the autoclave includes a fluid circulation system containing a circulation pump and said device, and wherein at least one powdered dyestuff is brought in contact with the supercritical fluid, thereby forming at least one of a stable solution and a dispersion of the dyestuff in the supercritical fluid, said device comprising:

a dyestuff feed mechanism having at least one dyestuff uptake section; and wherein the dyestuff feed mechanism is capable of moving between a first position in which the at least one dyestuff uptake section receives the dyestuff therein and a second position in which the at least one dyestuff uptake section is in contact with the supercritical fluid, and vice versa.

2. The device according to claim 1, characterized in that the dyestuff feed mechanism comprises a rod that can be displaced across the direction of flow of the supercritical fluid in said device, whereby the rod has at least one dyestuff uptake section including a through-hole.

3. The device according to claim 2, characterized in that the device has a cylindrical housing, which is provided with a connecting area to supply the supercritical fluid and a discharge area for discharging the supercritical fluid loaded with dyestuff, and that the dyestuff feed mechanism is provided inside the housing.

4. The device according to claim 3, characterized in that the housing is provided with opposing covers.

5. The device according to claim 4, characterized in that the covers have bearing and sealing elements for fluid-tight axially displaceable bearing of the dyestuff feed mechanism designed as a rod.

6. The device according to claim 2, characterized in that the dyestuff feed mechanism comprises a rod having at least one through-hole, said through-hole having a head, a foot, and a removable sieve plate adjacent at least one of the head and the foot.

7. The device according to claim 6, characterized in that the sieve plate is a sintered metal plate whose pores have a pore size equal to 30 $\mu$m.

8. The device according to claim 6, characterized in that the sieve plate is a sintered metal plate whose pores have a pore size less than 15 $\mu$m.

9. The device according to claim 6, characterized in that the sieve plate is a sintered metal plate whose pores have a pore size less than 30 $\mu$m.

10. The device according to claim 1, characterized in that the dyestuff feed mechanism comprises a dyestuff charging device.

* * * * *